US010743099B2

(12) United States Patent
Sakaguchi et al.

(10) Patent No.: US 10,743,099 B2
(45) Date of Patent: Aug. 11, 2020

(54) AREA REPRODUCTION SYSTEM AND AREA REPRODUCTION METHOD

(71) Applicant: Panasonic Intellectual Property Corporation of America, Torrance, CA (US)

(72) Inventors: Atsushi Sakaguchi, Kyoto (JP); Toshiyuki Matsumura, Osaka (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 0 days.

(21) Appl. No.: 16/452,931

(22) Filed: Jun. 26, 2019

(65) Prior Publication Data

US 2020/0015001 A1 Jan. 9, 2020

(30) Foreign Application Priority Data

Jul. 4, 2018 (JP) ..... 2018-127278

(51) Int. Cl.
*H04R 1/32* (2006.01)

(52) U.S. Cl.
CPC ..... *H04R 1/323* (2013.01)

(58) Field of Classification Search
CPC ..... H04R 1/323; H04R 1/025; H04R 1/403; H04R 1/026; H04R 1/021; H04R 1/02; H04R 1/26; H04R 5/02; H04R 5/04; H04R 3/12; H04S 7/301; H04S 7/302; H04S 1/002; H04S 1/005; H04S 1/00; H04S 3/00
USPC ..... 381/303, 1, 300, 386, 387
See application file for complete search history.

(56) References Cited

U.S. PATENT DOCUMENTS

2010/0124150 A1* 5/2010 Kablotsky ..... H04R 1/403 367/138
2012/0020480 A1* 1/2012 Visser ..... H04R 3/12 381/17
2019/0230435 A1* 7/2019 Maeno ..... H04R 1/403

FOREIGN PATENT DOCUMENTS

JP 2015-231087 12/2015

* cited by examiner

*Primary Examiner* — Ahmad F. Matar
*Assistant Examiner* — Sabrina Diaz
(74) *Attorney, Agent, or Firm* — Wenderoth, Lind & Ponack, L.L.P.

(57) ABSTRACT

Provided is an area reproduction system including a reproduction unit including a speaker array, a processing unit that processes a reproduction sound to be output from each of a plurality of speakers included the speaker array, based on a control line including a reproduction line that strengthens a sound wave radiated from the speaker array and a non-reproduction line that weakens the sound wave, so that an audio beam of a predetermined sound pressure or more is radiated only to the reproduction line, the control line being substantially parallel with the speaker array and being set in a position separated from the speaker array, and a directional angle control unit that adjusts a phase of the reproduction sound so that a radiating direction of the audio beam is deflected by a specified angle, in which each of the plurality of speakers outputs the processed and adjusted reproduction sound.

5 Claims, 13 Drawing Sheets

AREA REPRODUCTION SYSTEM AND AREA REPRODUCTION METHOD

FIELD OF THE INVENTION

The present disclosure relates to an area reproduction system and an area reproduction method.

BACKGROUND ART

Conventionally, a known technique is an area reproduction technique that presents sound only to specified positions using a speaker array configured by disposing a plurality of speakers linearly, and thus presents different sounds to different positions in one space without interference. Use of this technique makes it possible to present reproduction sounds of different contents and different volumes to users.

Specifically, as disclosed in JP 2015-231087 A, a reproduction line that strengthens reproduction sounds and a non-reproduction line that weakens reproduction sounds are set on a control line which is parallel with a speaker array, and a control filter for radiating an audio beam of a predetermined sound pressure or more only to the set reproduction line is derived. A signal, which is obtained by convolving the signal of the reproduction sound with the derived control filter, is output from the speakers so that an audio beam is radiated only to the set reproduction line.

The above-described conventional technique has, however, a problem that an audio beam radiable range is limited by a length of the speaker array in a longitudinal direction.

SUMMARY OF THE INVENTION

In order to solve the above problem, it is an object of the present disclosure to provide an area reproduction system and an area reproduction method that prevent an audio beam radiable range from being limited by a length of a speaker array in a longitudinal direction.

One aspect of the present disclosure provides an area reproduction system including a reproduction unit including a speaker array configured by disposing a plurality of speakers linearly, a processing unit that executes processing for processing a reproduction sound to be output from each of the plurality of speakers, based on a control line including a reproduction line that strengthens a sound wave radiated from the speaker array and a non-reproduction line that weakens the sound wave, so that an audio beam of a predetermined sound pressure or more is radiated only to the reproduction line, the control line being substantially parallel with the speaker array and being set in a position separated from the speaker array by a predetermined distance, and a directional angle control unit that executes a directional angle control process for adjusting a phase of the reproduction sound so that a radiating direction of the audio beam is deflected by a specified angle, in which the reproduction unit causes each of the plurality of speakers to output the reproduction sound which has been subject to the processing and the directional angle control process.

Another aspect of the present disclosure provides an area reproduction method being performed by a computer of an area reproduction system including a speaker array configured by disposing a plurality of speakers linearly, the method including: causing the computer to execute processing for processing a reproduction sound to be output from each of the plurality of speakers, based on a control line including a reproduction line that strengthens a sound wave radiated from the speaker array and a non-reproduction line that weakens the sound wave, so that an audio beam of a predetermined sound pressure or more is radiated only to the reproduction line, the control line being substantially parallel with the speaker array and being set in a position separated from the speaker array by a predetermined distance, and a directional angle control process for adjusting a phase of the reproduction sound so that a radiating direction of the audio beam is deflected by a specified angle; and causing each of the plurality of speakers to output the reproduction sound which has been subject to the processing and the directional angle control process.

DESCRIPTION OF EMBODIMENTS (Findings to be Basis of the Present Disclosure)

A principle of the present disclosure will be described. A reproduction sound to be output from a general speaker spherically propagates, and thus transmission of the reproduction sound only to a specific user cannot be performed. In recent years, therefore, area reproduction control based on space filtering is proposed (for example, JP 2015-231087 A). In this control, a reproduction sound can be controlled in not only a reproduction area to which a reproduction sound is desired to be transmitted but also a non-reproduction area to which a reproduction sound is undesired to be transmitted.

Figure 12:
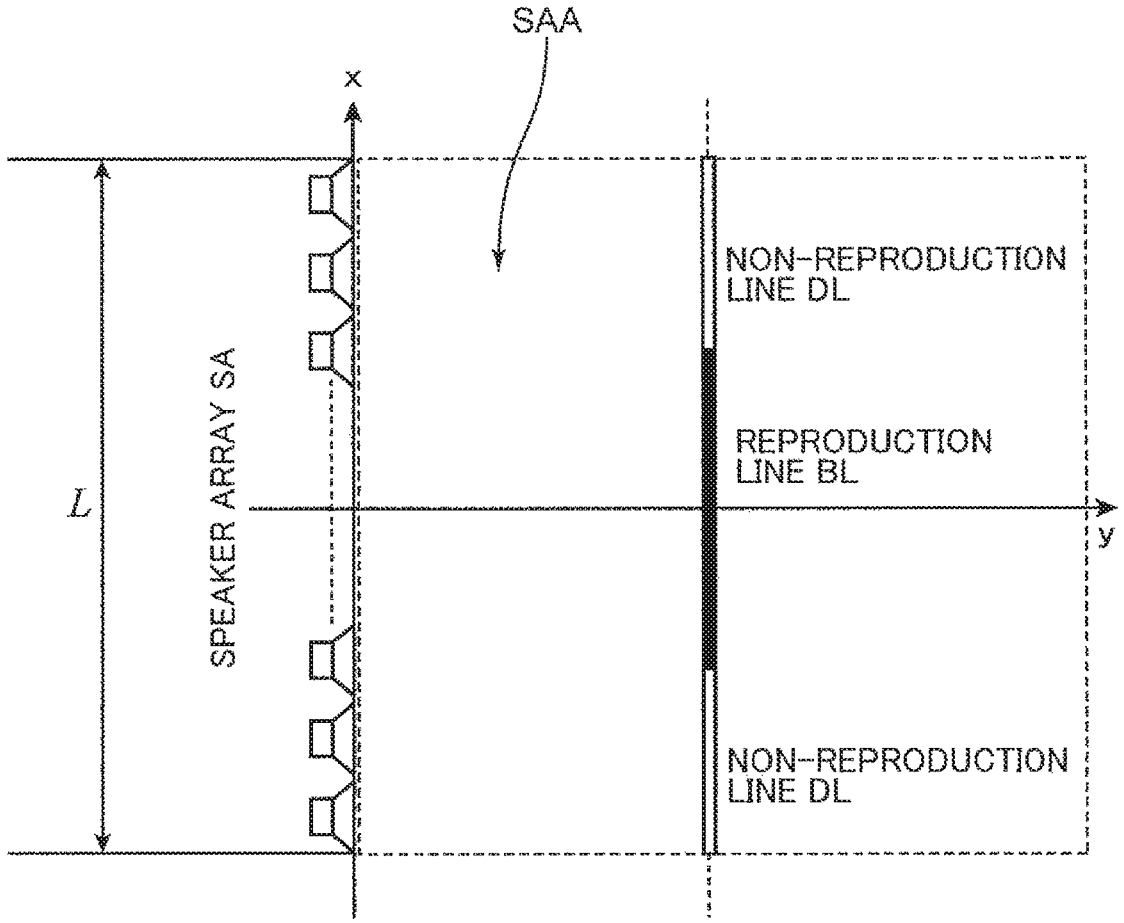
FIG. 12 is a diagram illustrating an example of a relationship between a speaker array and the reproduction line.
Figure 13:
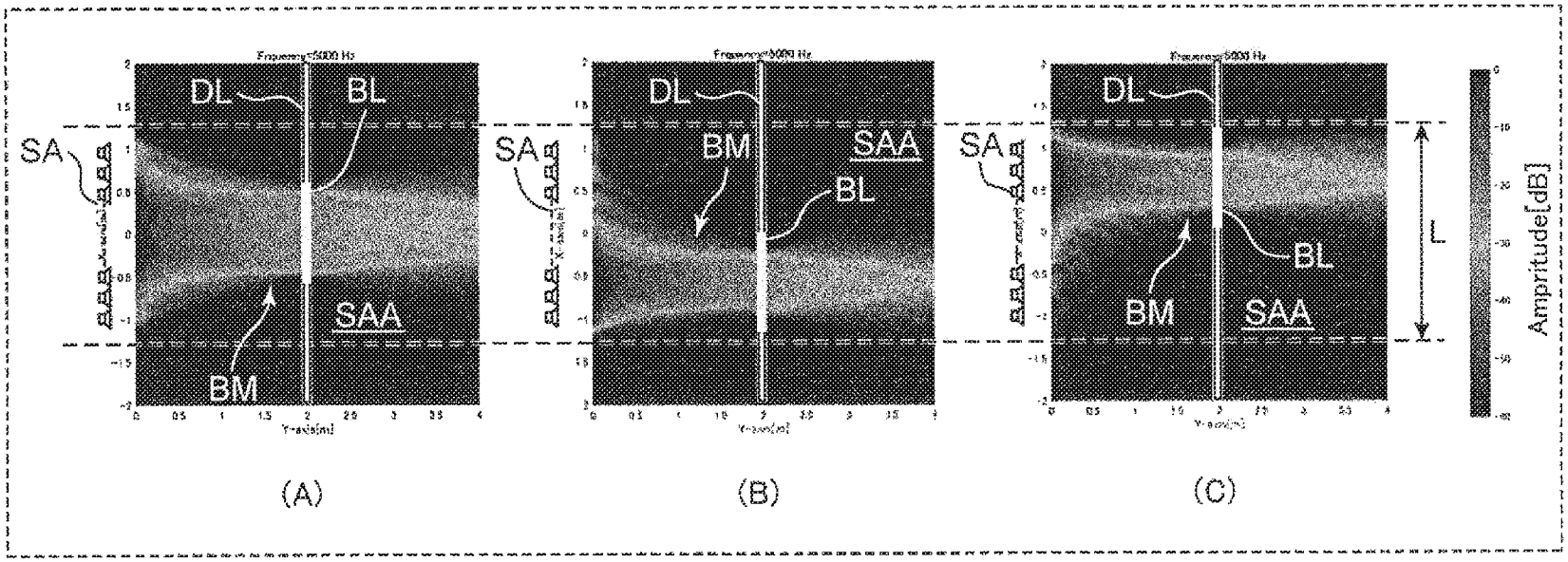
FIG. 13 is a diagram illustrating examples of modes for radiating an audio beam to the reproduction line.

FIG. 12 is a diagram illustrating an example of a relationship between a speaker array SA and a reproduction line BL. FIG. 13 is a diagram illustrating examples of modes for radiating an audio beam BM to the reproduction line BL.

Specifically, as illustrated in FIG. 12, the reproduction line BL that strengthens a reproduction sound and a non-reproduction line DL that weakens a reproduction sound are set so as to be parallel with the speaker array SA. A control filter, which is used for radiating an audio beam of a predetermined sound pressure or more only to the set reproduction line BL, is derived. A signal, which is obtained by convolving a signal of the reproduction sound with the derived control filter, is output from speakers. This results in, as illustrated in FIG. 13, radiation of an audio beam BM to the set reproduction line BL.

In a case where the above-described area reproduction technique is actually used, however, the reproduction line BL has to be set in an area SAA opposed to the speaker array SA so as to be parallel with the speaker array SA. Thus, as illustrated in FIG. 12, there is a problem in that a radiable range of the audio beam BM is limited by a length L of the speaker array SA in a longitudinal direction. No technical countermeasure for solving this problem has been examined.

In order to solve this problem, one aspect of the present disclosure provides an area reproduction system including a reproduction unit including a speaker array configured by disposing a plurality of speakers linearly, a processing unit that executes processing for processing a reproduction sound to be output from each of the plurality of speakers, based on a control line including a reproduction line that strengthens a sound wave radiated from the speaker array and a non-reproduction line that weakens the sound wave, so that an audio beam of a predetermined sound pressure or more is radiated only to the reproduction line, the control line being substantially parallel with the speaker array and being set in a position separated from the speaker array by a predetermined distance, and a directional angle control unit that executes a directional angle control process for adjusting a phase of the reproduction sound so that a radiating direction of the audio beam is deflected by a specified angle, in which the reproduction unit causes each of the plurality of speakers to output the reproduction sound which has been subject to the processing and the directional angle control process.

Another aspect of the present disclosure provides an area reproduction method being performed by a computer of an area reproduction system including a speaker array configured by disposing a plurality of speakers linearly, the method including: causing the computer to execute processing for processing a reproduction sound to be output from each of the plurality of speakers, based on a control line including a reproduction line that strengthens a sound wave radiated from the speaker array and a non-reproduction line that weakens the sound wave, so that an audio beam of a predetermined sound pressure or more is radiated only to the reproduction line, the control line being substantially parallel with the speaker array and being set in a position separated from the speaker array by a predetermined distance, and a directional angle control process for adjusting a phase of the reproduction sound so that a radiating direction of the audio beam is deflected by a specified angle; and causing each of the plurality of speakers to output the reproduction sound which has been subject to the processing and the directional angle control process.

According to these aspects, the processing causes the audio beam of a predetermined sound pressure or more to be radiated only to the reproduction line set parallel with the speaker array. The directional angle control process causes the reproduction sound, whose phase is adjusted so that the radiating direction of the audio beam is deflected by a specified angle, to be output from each of the plurality of speakers.

Thus, the audio beam can be radiated to a direction where a direction toward the reproduction line is deflected by the specified angle. Therefore, even if the reproduction line is set in a position opposed to an end of the speaker array in the longitudinal direction, the audio beam can be radiated to an area which is not opposed to the speaker array. Thus, the radiable range of the audio beam can be avoided from being limited by the length of the speaker array in the longitudinal direction.

In the above aspects, the processing unit may convolve a reproduction sound signal representing the reproduction sound with a control filter which achieves the control line and generates a convolved signal as a drive signal for causing each of the plurality of speakers to output the reproduction sound in the processing, and the directional angle control unit, in the directional angle control process, may adjust a phase of the drive signal generated in the processing.

According to the present aspect, in the processing, the reproduction sound signal representing the reproduction sound is convolved with the control filter which achieves the control line, and then the drive signal, whose phase has been adjusted in directional angle control process, is output from each of the plurality of speakers.

Thus, a specified angle different from a previous angle is set, and the directional angle control process can be executed by reusing the drive signal generated in the previous processing. In this case, the radiating direction of the audio beam can be adjusted more quickly than in a case where a control line and a specified angle which are different from previous ones are set and the processing and the directional angle control process are executed.

In the above aspects, a frequency of the reproduction sound may satisfy a following formula using a disposing interval of the plurality of speakers, a sound speed, and the specified angle:

$$f < \frac{c}{\Delta x(1 + \sin\theta)} \quad \text{[Expression 1]}$$

where, f represents the frequency of the reproduction sound, Δx represents the disposing interval of the plurality of speakers, c represents the sound speed, and θ represents the specified angle.

It is known that if the plurality of speakers outputs reproduction sound with frequency which does not satisfy the above formula, a grating lobe is generated. In the present aspect, the reproduction sound with the frequency which satisfies the above formula is output, and thus the generation of a grating lobe can be avoided.

In the above aspects, the area reproduction system further includes a first synthesizing unit that synthesizes the reproduction sound that has been subject to the processing and the directional angle control process with the reproduction sound that has been subject to the processing. The reproduction unit may cause the plurality of speakers to output a first synthesized reproduction sound synthesized by the first synthesizing unit.

According to the present aspects, in the processing and the directional angle control process, the reproduction sounds are adjusted so that the audio beam is radiated to a direction where the direction toward the reproduction line is deflected by a specified angle. In the processing, the reproduction sound is processed so that the audio beam is radiated only to the reproduction line. The first synthesized reproduction sound obtained by synthesizing the adjusted reproduction sound with the processed reproduction sound is output from the plurality of speakers.

Therefore, the audio beam of the former reproduction sound can be radiated to a partial area of the non-reproduction line on the control line, and the audio beam of the latter reproduction sound can be radiated to the reproduction line. This makes the radiating range of the audio beam on the control line wider than a range of the reproduction line.

In the above aspects, the processing unit further executes additional processing for processing an additional reproduction sound identical to the reproduction sound, based on an additional control line including an additional reproduction line that strengthens a sound wave radiated from the speaker array and an additional non-reproduction line that weakens the sound wave, so that an additional audio beam of the predetermined sound pressure or more is radiated only to the additional reproduction line, the additional control line being substantially parallel with the speaker array and being set in a position separated from the speaker array by the predetermined distance. The directional angle control unit further executes an intersection adjusting process for adjusting a phase of the additional reproduction sound so that a part of the audio beam intersects a part of the additional audio beam in a position separated from the speaker array by the predetermined distance. The area reproduction system further includes a second synthesizing unit that synthesizes the reproduction sound which has been subject to the processing and the directional angle control process with the additional reproduction sound which has been subject to the additional processing and the intersection adjusting process. The reproduction unit may cause the plurality of speakers to output a second synthesized reproduction sound synthesized by the second synthesizing unit.

According to the present aspects, in the processing and the directional angle control process, the reproduction sounds are adjusted so that the audio beam is radiated to a direction where the direction toward the reproduction line is deflected by a specified angle. In the additional processing and the intersection adjusting process, the additional reproduction sound identical to the reproduction sound is adjusted so that a part of the audio beam and a part of the additional audio beam intersect each other in the position separated from the speaker array by a predetermined distance. The second synthesized reproduction sound obtained by synthesizing the adjusted reproduction sound with the adjusted additional reproduction sound is output from the plurality of speakers.

Thus, a part of the audio beam and a part of the additional audio beam can intersect each other on the control line. This makes it possible to increase the sound pressure of the reproduction sound in an area where a part of the audio beam and a part of the additional audio beam intersect on the control line.

Embodiments described below illustrate specific examples of the present disclosure. Numerical values, shapes, components, steps, and an order of the steps described in the following embodiments are examples, and thus do not limit the present disclosure. In the components in the following embodiments, components which are not described in independent claims representing highest-order concepts will be described as any components. In all the embodiments, their contents can be combined.

(Overall Image of System)

An overall image of the area reproduction system according to the embodiments of the present disclosure will be described.

Figure 1:
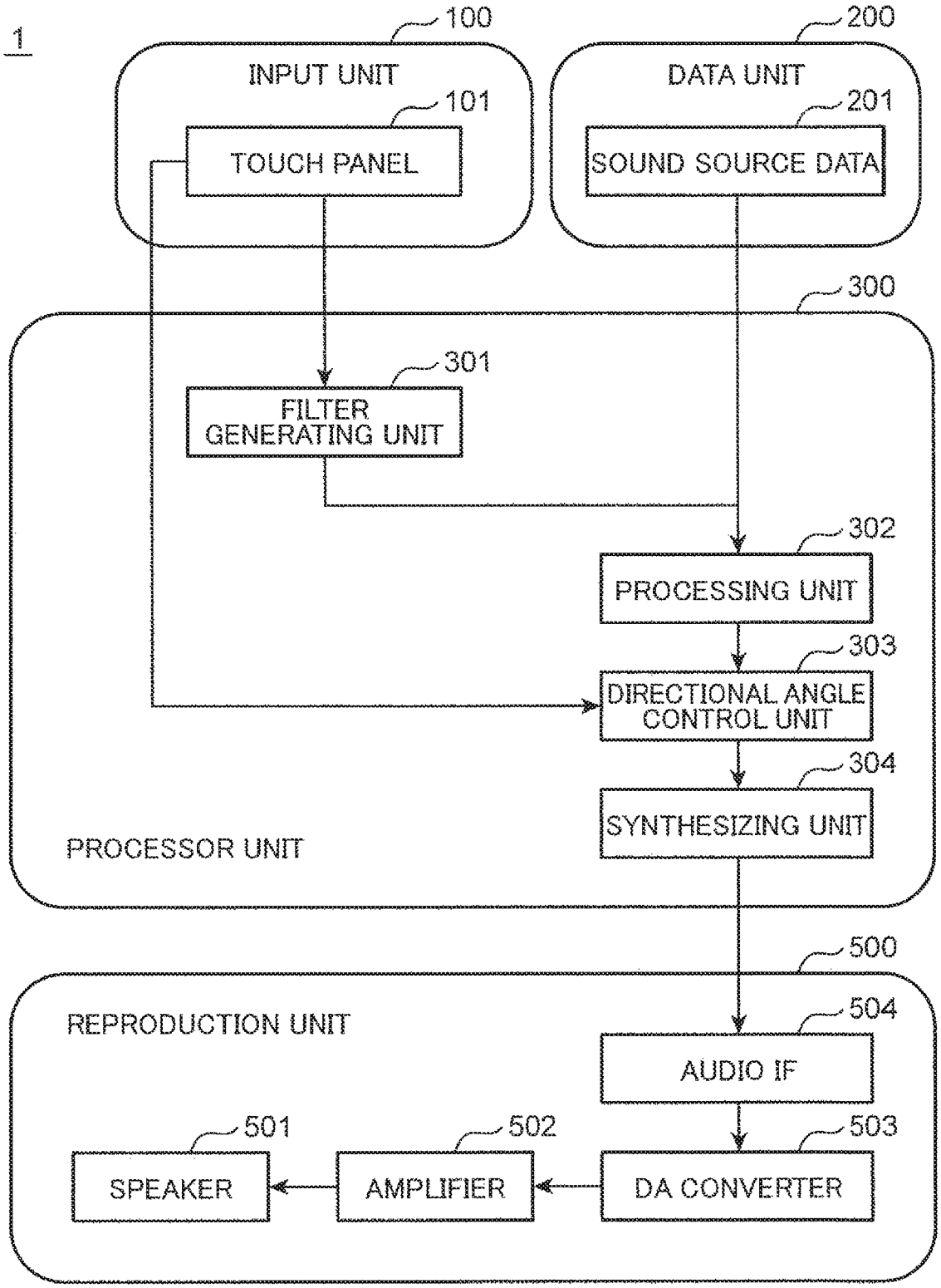
FIG. 1 is a diagram illustrating a configuration of an area reproduction system according to an embodiment of the present disclosure.

FIG. 1 is a diagram illustrating a configuration of an area reproduction system 1 according to an embodiment of the present disclosure. The area reproduction system 1 includes an input unit 100, a data unit 200, the processor unit 300, and a reproduction unit 500.

The input unit 100 is a terminal device including a touch panel 101 to be used for performing various setting operations for sound source data 201 of reproduction sound to be reproduced by speakers 501, described later, and reproduction conditions, described later, and the like. The input unit 100 is not limited to the touch panel 101, and thus may be a terminal device having physical keyboards and mouse, or user interfaces (UI) which can be used for the setting operations through gestures.

The input unit 100 may be a terminal device such as a smartphone or a tablet to be used by a user of the area reproduction system 1. Further, the input unit 100 may be a terminal device such as a personal computer which is installed in a room to be a target for the area reproduction by the area reproduction system 1 and is shared by a plurality of users.

The data unit 200 is a storage device such as a random access memory (RAM) or a hard disk drive (HDD). The data unit 200 stores the sound source data 201 representing reproduction sound. The sound source data 201 is transmitted to the processor unit 300 via a network such as an internet. The data unit 200 may be installed in a device of the processor unit 300, or in a device different from the processor unit 300.

The processor unit 300 is an information processing device (an example of a computer) including a microprocessor, a read only memory (ROM), a RAM, an HDD, a keyboard, a mouse, and a display unit. The processor unit 300 is communicably connected to an audio interface (IF) 504, described later, via a local area network (LAN), Bluetooth (registered trademark), an audio and visual (AV) cable, or the like. Even if the processor unit 300 is unconnectable to an internet by itself, the processor unit 300 may be connectable to an internet via a home gateway. Details of the processor unit 300 will be described later. The processor unit 300 may be disposed in a device of the audio IF 504 and may be connected to the audio IF 504 via the AV cable or the like.

The reproduction unit 500 is an audio output device including the audio IF 504, a digital-analog (DA) converter 503, an amplifier 502, and the speakers 501. The audio IF 504 transmits and receives audio data. The DA converter 503 converts audio data input from the audio IF 504 into an analog signal. The amplifier 502 amplifies the analog signal converted by the DA converter 503. The speaker 501 outputs a reproduction sound represented by the signal amplified by the amplifier 502.

The reproduction unit 500 has the plurality of speakers 501 and the speaker array SA (FIG. 2) which is configured by disposing the plurality of speakers 501 linearly at predetermined intervals. As described later, performance of the area reproduction changes in accordance with a disposing interval $\Delta x$ of the speakers 501 and the length L of the speaker array SA in the longitudinal direction and the like. A type and a scale of the speakers 501 are not limited.

(Details of Processor Unit 300)

The processor unit 300 will be described in detail below. As illustrated in FIG. 1, the processor unit 300 includes a filter generating unit 301, a processing unit 302, a directional angle control unit 303, and a synthesizing unit 304 (an example of the first synthesizing unit and an example of the second synthesizing unit).

The filter generating unit 301 generates a control filter that achieves the control line, described later, included in the reproduction condition specified by the user through the input unit 100. Details of a method for generating the control filter in the filter generating unit 301 will be described later.

The processing unit 302 executes the processing for processing the reproduction sound output from the plurality of speakers 501 using the control filter generated by the filter generating unit 301 so that the control line included in the reproduction condition specified by the user through the input unit 100 is achieved.

Specifically, the processing unit 302 converts, in the processing, the sound source data 201 into analog signal, the sound source data 201 being specified by the user through the input unit 100 and representing the reproduction sound to be output from the plurality of speakers 501. The processing unit 302 then generates a signal, which is obtained by convolving the analog signal (hereinafter, a reproduction sound signal corresponding to the sound source data 201) with the control filter generated by the filter generating unit 301, as a drive signal for causing each of the plurality of speakers 501 to output the reproduction sound.

The directional angle control unit 303 executes a directional angle control process for adjusting phase of the reproduction sound output from each of the plurality of speakers 501 so that a radiating direction of the audio beam is deflected by a deflection angle (an example of the specified angle), described later, when the reproduction condition specified by the user through the input unit 100 includes the deflection angle.

Specifically, in the directional angle control process, the directional angle control unit 303 adjusts a phase of the drive signal, which is generated by the processing unit 302, of each speaker so as to adjust drive start timings of the speakers 501. Thus, the directional angle control unit 303 adjusts the phase of the reproduction sound to be output from each of the plurality of speakers 501. The directional angle control unit 303 outputs the drive signal whose phase has been adjusted to the synthesizing unit 304. Details of a method for adjusting the phase of the reproduction sound in the directional angle control unit 303 will be described later.

When the reproduction condition specified by the user through the input unit 100 does not include the deflection angle, the directional angle control unit 303 outputs the drive signal generated by the processing unit 302 directly to the synthesizing unit 304.

When receiving the drive signals for outputting a plurality of reproduction sounds, the synthesizing unit 304 synthesizes the input drive signals for outputting the reproduction sounds. The synthesizing unit 304 transmits the synthesized drive signals to the reproduction unit 500 as drive signals for outputting synthesized reproduction sounds (examples of the first synthesized reproduction sound and the second synthesized reproduction sound) obtained by synthesizing the plurality of reproduction sounds to the plurality of speakers 501, respectively. When receiving a drive signal for outputting one reproduction sound from the directional angle control unit 303, the synthesizing unit 304 transmits the input drive signal directly to the reproduction unit 500.

(Method for Generating Control Filter)

Details of a method for generating the control filter in the filter generating unit 301 will be described. Hereinafter, the speakers 501 each of which is a component of the speaker array SA are disposed to be aligned on an x axis. On a plane represented by the x axis and a y axis perpendicular to the x axis, a reproduction sound, which has an angular frequency ω and is output from the speaker 501 in a position A (x0, 0) of the speaker array SA, includes a reproduction sound which has a sound pressure P(x, yref, ω) and the angular frequency ω, and reaches a control point B(x, yref). The sound pressure P(x, yref, ω) is expressed by a following formula (1).

[Expression 2]

$$P(x,y_{ref},\omega)=\int_{-\infty}^{\infty}D(x_0,0,\omega)G(x-x_0,y_{ref},\omega)dx_0 \quad (1)$$

In the formula (1), D (x0, 0, ω) represents a drive signal of each speaker, and G (x-x0, yref, ω) represents a transfer function from each speaker 501 to a control point B (x, yref). The transfer function G (x-x0, yref, ω) is a Green function in a three-dimensional free space. When the frequency of a reproduction sound is represented by f, the angular frequency co of the reproduction sound is expressed by 2πf (ω=2πf).

A following formula (2) is derived by applying convolution theorem to a result of Fourier-transforming the formula (1) to an x axis direction.

[Expression 3]

$$\tilde{P}(k_x,y_{ref},\omega)=\tilde{D}(k_x,\omega)\cdot\tilde{G}(k_x,y_{ref},\omega) \quad (2)$$

Herein, "~" represents a value in a wavenumber domain. kx represents a space frequency in the x axis direction. When S(ω) represents the reproduction sound signal to be output from the speaker 501 and F (x0, 0, ω) represents the control filter, a drive signal D (x0, 0, ω) of the speaker at a point A is expressed by a following formula (3).

[Expression 4]

$$D(x_0,0,\omega)=S(\omega)F(x_0,0,\omega) \quad (3)$$

The control filter F (x0, 0, ω) does not depend on the reproduction sound, and thus S(ω)=hereinafter. Therefore, a following formula (4) is derived from a result of Fourier-transforming the formula (3) to the x axis direction and the formula (2).

[Expression 5]

$$\tilde{F}(k_x,\omega)=\frac{\tilde{P}(k_x,y_{ref},\omega)}{\tilde{G}(k_x,y_{ref},\omega)} \quad (4)$$

Figure 2:
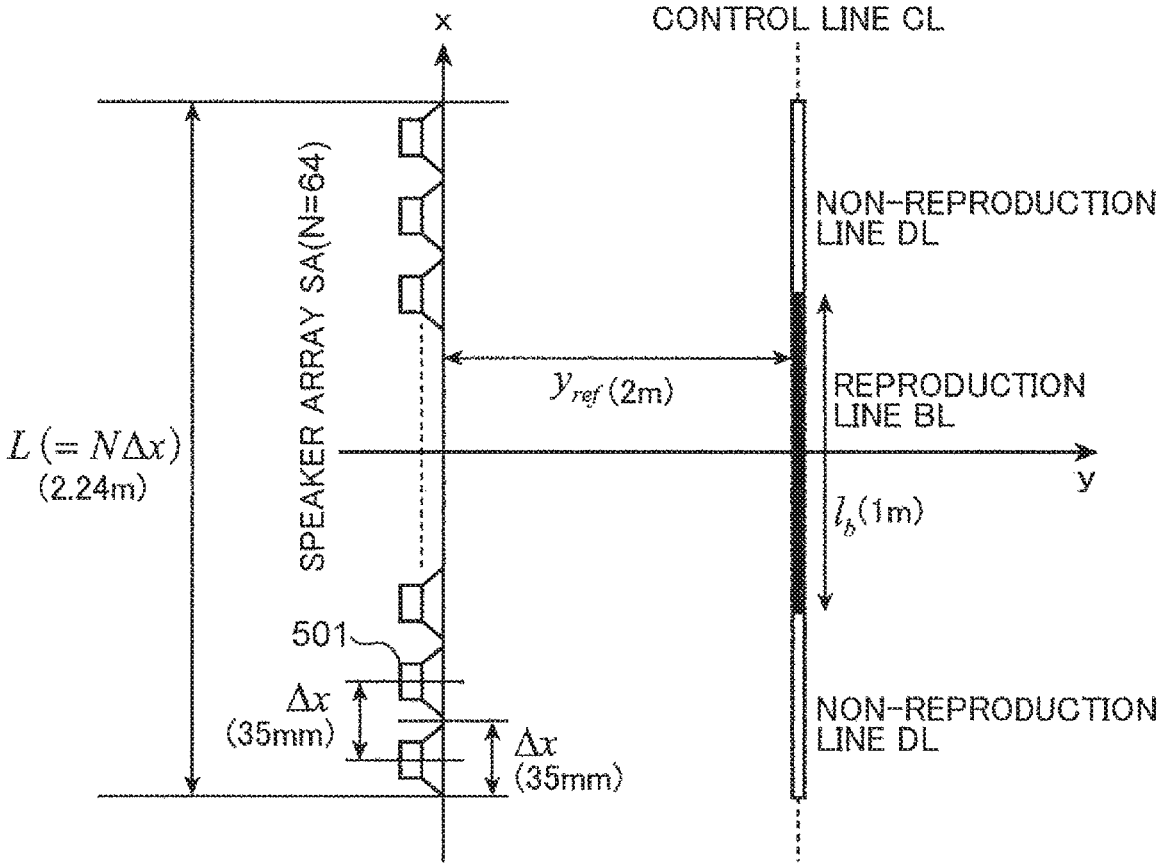
FIG. 2 is a diagram illustrating an example of setting of a reproduction line and a non-reproduction line.

FIG. 2 is a diagram illustrating an example of setting the reproduction line BL and the non-reproduction line DL. In order to achieve the area reproduction, as illustrated in FIG. 2, the reproduction line BL which strengthens a sound wave radiated from the speaker array SA and the non-reproduction line DL that weakens the sound wave may be set on a control line CL, which is substantially parallel with the speaker array SA and is set in a position separated from the speaker array SA by a distance yref. In the embodiment of the present disclosure, a length (hereinafter, a width of the reproduction line BL) of the reproduction line BL in the x axis direction is represented by lb. A center x of the reproduction line BL in the x axis direction is 0, and the sound pressure P(x, yref, ω) of the reproduction sound reaching the control point B(x, yref) on the control line CL is modelized as a square wave expressed by a following formula (5).

[Expression 6]

$$P(x, y_{ref}, \omega) = \begin{cases} 1, & \text{for } |x| \le \frac{l_b}{2} \\ 0, & \text{otherwise} \end{cases} \quad (5)$$

In the formula (5), the sound pressure P(x, yref, ω) of the reproduction sound is modelized in a state that the sound pressure is regarded as "1" or "0", but is not limited to this, and thus the sound pressure P(x, yref, ω) of the reproduction sound may be modeled in a state that the sound pressure has a predetermined value (an example of the predetermined sound pressure) of at least "1" or "0".

A control filter F(x, 0, ω) which achieves the area reproduction can be analytically derived as expressed in a formula (6) by assigning the sound pressure of the reproduction sound in the wavenumber domain obtained by Fourier-transforming the formula (5) to the x axis direction into the formula (4), and inversely Fourier-transforming a control filter in a wavenumber domain obtained by the assignment.

[Expression 7]

$$F(x, 0, \omega) = F^{-1}\left[\frac{l_b \mathrm{sinc}(k_x l_b / 2\pi)}{\tilde{G}(k_x, y_{ref}, \omega)}\right] \quad (6)$$

Herein, $F^{-1}$[ ] in a right side represents the inverse Fourier transform, and a formula described in [ ] represents the control filter in the wavenumber domain.

The formula (6) is derived when the speakers 501 of the speaker array SA are regarded to be infinitely disposed on the x axis. Actually, a finite number of the speakers 501 of the speaker array SA are disposed, and thus the control filter F(x, 0, ω) is necessarily discretized to be derived.

Specifically, as illustrated in FIG. 2, the number of the speakers 501 in the speaker array SA is represented by N, the disposing interval of the speakers 501 is represented by Δx, and the length of the speaker array SA in the x axis direction is represented by L. In this case, the discretized control filter F(x, 0, ω) can be analytically derived as expressed by a following formula (7) in a manner that a control filter in a wavenumber domain expressed by the formula in [ ] of a right side of the formula (6) is subject to discrete inverse Fourier transform.

[Expression 8]

$$F(x, 0, \omega) = \frac{1}{L}\sum_{m=-N/2}^{N/2-1}\left(\frac{l_b \mathrm{sinc}(k_x l_b / 2\pi)}{\tilde{G}(k_x, y_{ref}, \omega)}\right)\exp\left(\frac{2\pi jnm}{N}\right) \quad (7)$$

where $x = n\Delta x$ $(-N/2 \le n \le N/2-1)$, $L = N\Delta x$, $k_x = 2\pi m/N\Delta x$ The filter generating unit 301 assigns 1) the disposing interval Δx of the speakers 501, 2) the number N of the speakers 501 of the speaker array SA, 3) the distance yref from the speaker array SA to the control line CL in a y axis direction, and 4) the width lb of the reproduction line BL into the formula (7). Thus, the filter generating unit 301 generates the control filter F(x, 0, ω).

(Method for Adjusting Phase of Reproduction Sound)

Figure 3:
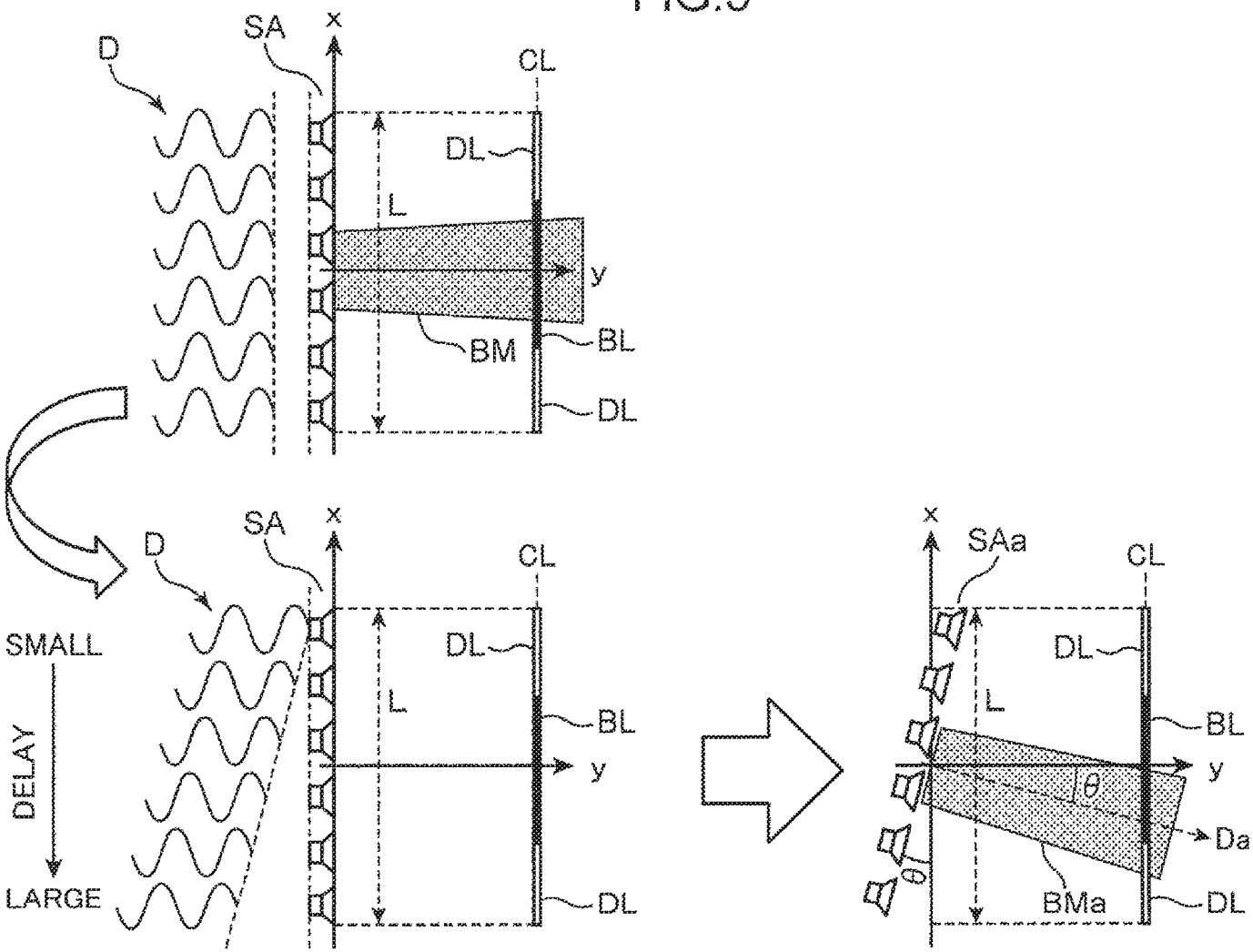
FIG. 3 is a diagram illustrating an example of adjustment for deflecting an audio beam radiating direction to a −X direction.

Details of a method for adjusting a phase of reproduction sound in the directional angle control unit 303 will be described below. FIG. 3 is a diagram illustrating an example of adjustment for deflecting a radiating direction of the audio beam BM (hereinafter, a radiating direction) to a −x direction. An upper left section of FIG. 3 illustrates an example of radiating the audio beam BM to the reproduction line BL. A lower left section of FIG. 3 illustrates an example of adjusting a phase of reproduction sound in the directional angle control unit 303. A lower right section of FIG. 3 illustrates an example of a result of deflecting the radiating direction of the audio beam BM by the adjustment of the phase of the reproduction sound illustrated in the lower left section of FIG. 3.

For example, as illustrated in the upper left section of FIG. 3, the user sets the reproduction line BL as the reproduction condition so that the center of the speaker array SA in the x direction aligns with the center of the reproduction line BL in the x direction. Accordingly, the user sets an area different from the reproduction line BL within a range opposed to the speaker array SA in the control line CL, as the non-reproduction line DL. The control filter which achieves the area reproduction under the reproduction condition is generated by the filter generating unit 301. The processing unit 302 generates a signal, which is obtained by convolving a reproduction sound signal corresponding to the sound source data 201 with the generated control filter, as the drive signal D of the plurality of speakers 501.

When the plurality of speakers 501 is driven by the drive signal D generated by the processing unit 302, as illustrated in the upper left section of FIG. 3, the audio beam BM is radiated to the y direction which is a front direction of the speaker array SA, and is radiated to the reproduction line BL.

However, the user desires to deflect the radiating direction of the audio beam BM to the −x direction by an angle "θ", and specifies a deflection angle representing the positive angle "θ" as the reproduction condition. In this case, the directional angle control unit 303 adjusts a phase of the drive signal D as illustrated in the lower left section of FIG. 3. That is, the directional angle control unit 303 adjusts the phase of the drive signal D so that drive start timing is delayed greater in the speakers 501, which is closer to an end of the −x direction as a direction which is specified by the user and where the radiating direction of the audio beam BM is deflected (hereinafter, the deflecting direction of the audio beam BM) in the speaker array SA.

When the drive signal D with the adjusted phase drives the plurality of speakers 501, as illustrated in the lower right section of FIG. 3, the audio beam BMa is radiated to a direction Da where the deflection angle "θ" is formed in the −x direction with respect to the y direction. In other words, the audio beam BMa is radiated to the front direction from a speaker array SAa which is the speaker array SA tilted to the y direction by the deflection angle "θ". Thus, the audio beam BMa is radiated also to a position in the −x direction with respect to one end of the reproduction line BL in the −x direction.

Figure 4:
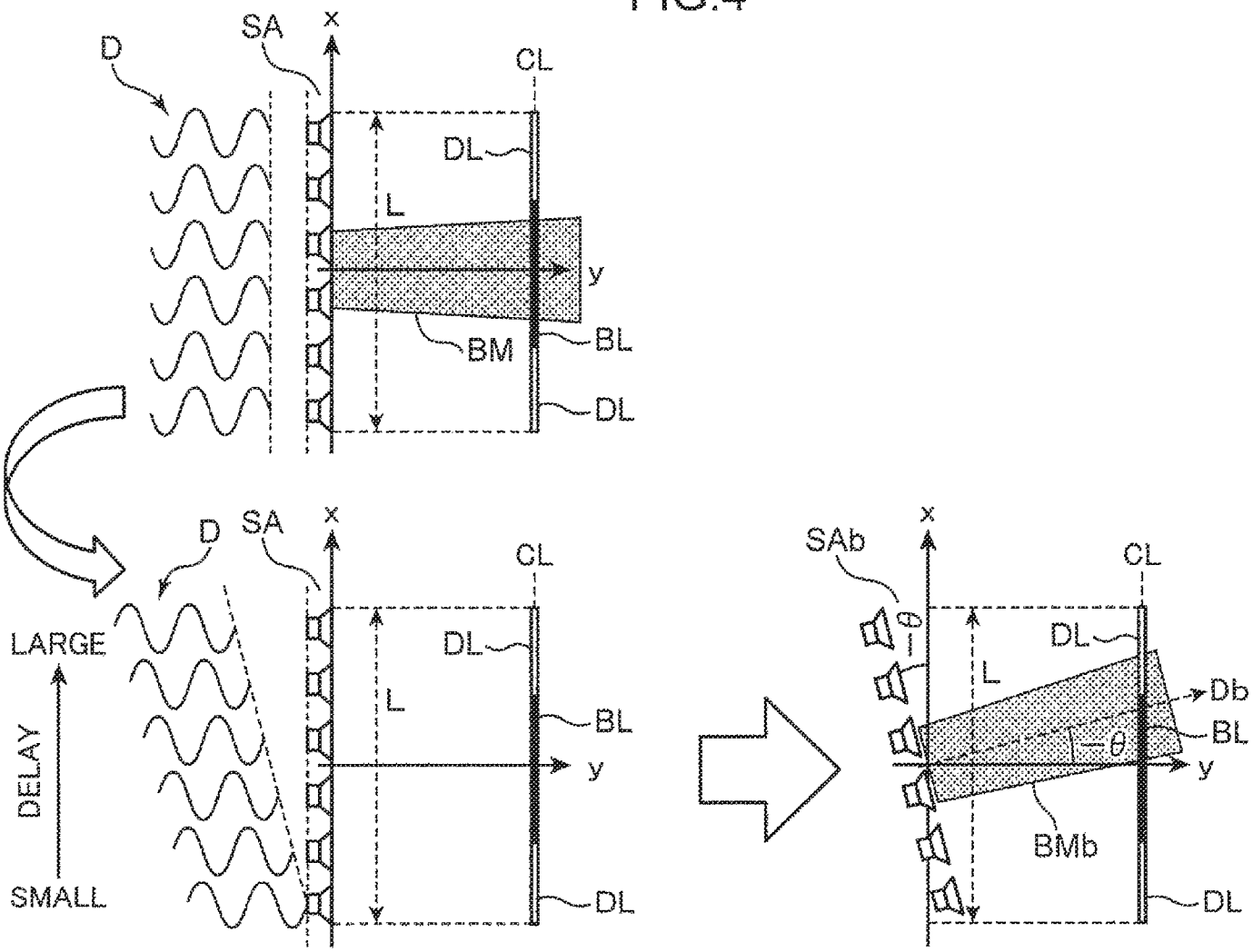
FIG. 4 is a diagram illustrating an example of adjustment for deflecting the audio beam radiating direction to an X direction.

FIG. 4 is a diagram illustrating an example of adjustment for deflecting the radiating direction of the audio beam BM to the x direction. An upper left section of FIG. 4 is same as the upper left section of FIG. 3. The upper left section of FIG. 4 illustrates an example where the audio beam BM is radiated to the y direction as the front direction of the speaker array SA and the audio beam BM is radiated to the reproduction line BL. A lower left section of FIG. 4 illustrates another example of adjusting phase of reproduction sound in the directional angle control unit 303. A lower right section of FIG. 4 illustrates an example of a result of deflecting the radiating direction of the audio beam BM by the adjustment of the phase of the reproduction sound illustrated in the lower left section of FIG. 4.

For example, the user desires to deflect the radiating direction of the audio beam BM to the x direction by the angle "θ", and specifies a deflection angle representing a negative angle "−θ" as the reproduction condition. In this case, the directional angle control unit 303 adjusts the phase of the drive signal D as illustrated in the lower left section of FIG. 4. That is, the directional angle control unit 303 adjusts the phase of the drive signal D so that the drive start timing is delayed greater in the speakers 501 which is closer to the end of the x direction as a deflecting direction, specified by the user, of the audio beam BM in the speaker array SA.

When the drive signal D with the adjusted phase drives the plurality of speakers 501, as illustrated in the lower right section of FIG. 4, an audio beam BMb is radiated to a direction Db where the deflection angle "−θ" is formed in the −x direction with respect to the y direction (a direction where the angle "θ" is formed in the x direction). In other words, the audio beam BMb is radiated to the front direction from a speaker array SAb which is obtained by tilting the speaker array SA to the y direction by the deflection angle "−θ" (the angle "θ" in the y direction). Thus, the audio beam BMb is radiated also to a position in the x direction with respect to one end of the reproduction line BL in the x direction.

(Method for Calculating Delay Time)

The directional angle control unit 303 calculates delay timer as time, at which the drive start timing is delayed between the two adjacent speakers 501, based on the deflection angle specified by the user. The method for calculating the delay time τ will be described with reference to a specific example illustrated in FIG. 3. For example, as illustrated in FIG. 3, the radiating direction of the audio beam BM is deflected from the y direction to the direction Da where the deflection angle "θ" is formed in the −x direction with respect to the y direction.

Figure 5:
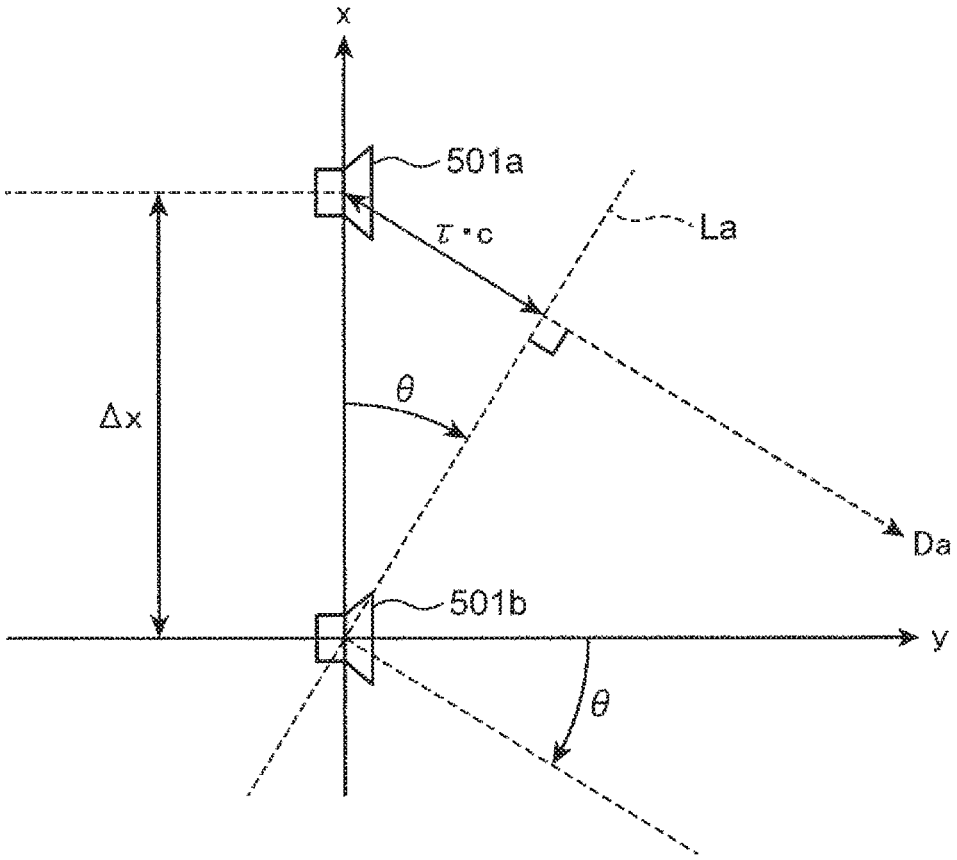
FIG. 5 is a diagram illustrating a relationship between a delay time and a deflection angle.

FIG. 5 is a diagram illustrating a relationship between the delay time τ and the deflection angle. In this case, as illustrated in FIG. 5, the two speakers 501*a*, 501*b* are adjacent to each other, and the speaker 501*b* may start to drive at a time when a sound wave of a sound speed c, the sound wave being output to the direction Da from the speaker 501*a* which starts to drive first, intersects a straight line La on which the x axis tilts to the y direction by the deflection angle "θ". Thus, the sound wave is strengthened in a position parallel with the straight line La, and the audio beam BM is radiated to the direction Da perpendicular to the straight line La.

A distance through which the sound wave output from the speaker 501*a* moves until it intersects the straight line La can be expressed by a product of the disposing interval Δx of the plurality of speakers 501 included in the speaker array SA and a sine function sin θ of the deflection angle θ or a product of the sound speed c and the delay time τ. Therefore, the directional angle control unit 303 calculates the delay time τ using a following formula (9) derived by deforming a following formula (8) representing that the two products are identical to each other.

[Expression 9]

$$\Delta x \cdot \sin\theta = \tau \cdot c \tag{8}$$

[Expression 10]

$$\tau = (\Delta x \cdot \sin\theta)/c \tag{9}$$

That is, as illustrated in the lower right section of FIG. 3, when the radiating direction of the audio beam BM is deflected to the −x direction, the directional angle control unit 303 delays, by the delay time τ, the phase of the drive signal D of the speaker 501 disposed first from a reference position in the −x direction, the reference position being a center position of the speaker array SA in the x direction.

In a similar manner, the directional angle control unit 303 delays, by a delay time 2τ, the phase of the drive signal D of the speaker 501 disposed second from the reference position in the −x direction. That is, the directional angle control unit 303 delays, by the delay time m·τ, the phase of the drive signal D of the speaker 501, which is disposed m-th from the reference position in the −x direction. On the contrary, the directional angle control unit 303 causes the phase of the drive signal D of the speaker 501, which is disposed m-th from the reference position in the x direction, to be early by the delay time m·τ.

On the other hand, as illustrated in the lower right section of FIG. 4, when the radiating direction of the audio beam BM is deflected to the x direction, the directional angle control unit 303 delays, by the delay time τ, the phase of the drive signal D of the speaker 501, which is disposed first from the reference position in the x direction.

In a similar manner, the directional angle control unit 303 delays, by a delay time 2τ, the phase of the drive signal D of the speaker 501, which is disposed second from the reference position in the x direction. That is, the directional angle control unit 303 delays, by the delay time m·τ, the phase of the drive signal D of the speaker 501, which is disposed m-th from the reference position in the x direction. On the contrary, the directional angle control unit 303 causes the phase of the drive signal D of the speaker 501, which is disposed m-th from the reference position in the −x direction, to be early by the delay time m·τ.

(Operation of Area Reproduction)

Figure 6:
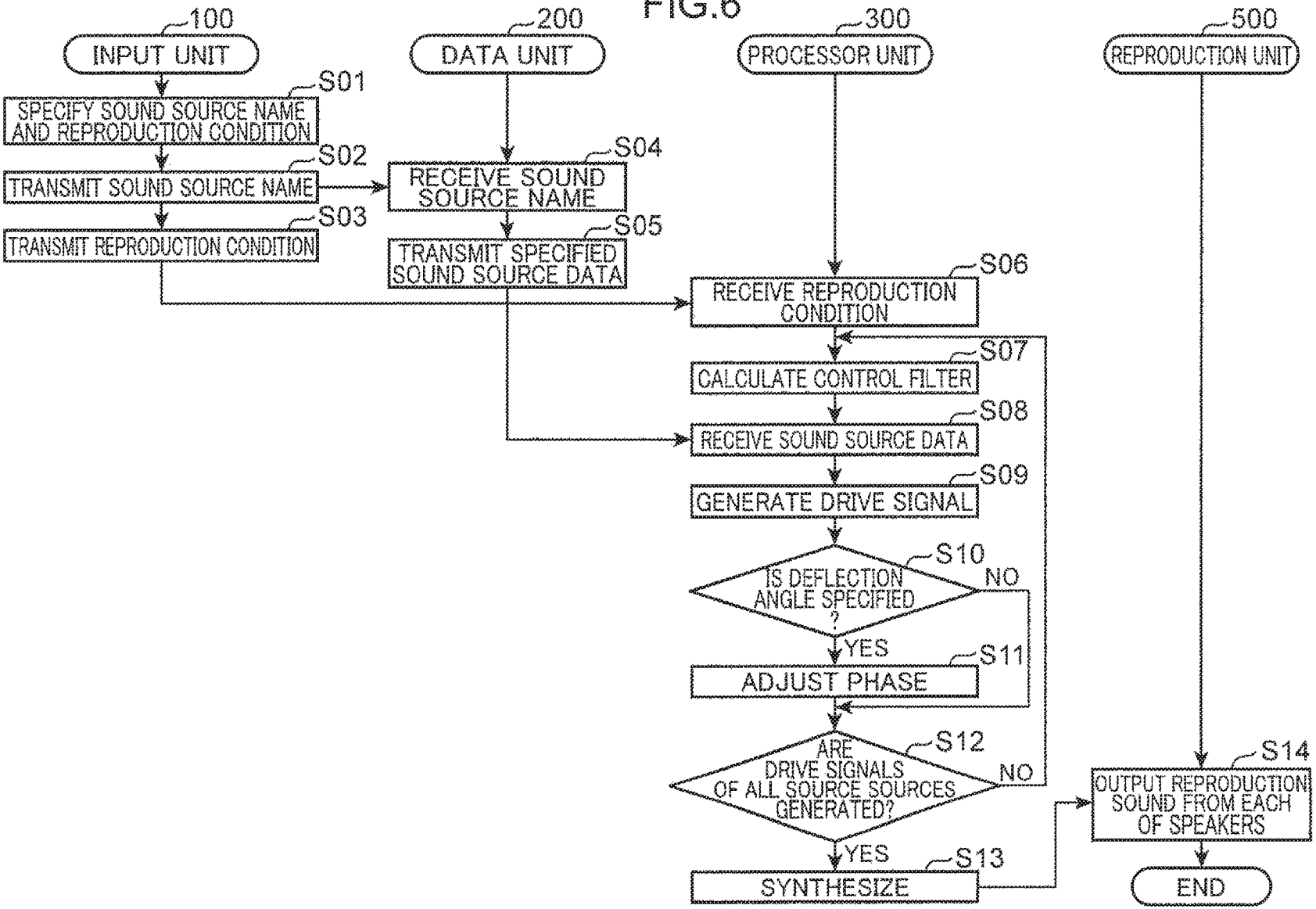
FIG. 6 is a flowchart illustrating an example of an area reproduction operation.

The area reproduction method to be performed by the area reproduction system 1 will be described below. FIG. 6 is a flowchart illustrating an example of the area reproduction operation. When the user specifies a name of the sound source data 201 of the reproduction sound (hereinafter, a sound source name) and a reproduction condition using the touch panel 101 (step S01), the input unit 100 transmits the specified sound source name to the data unit 200 (step S02) and the specified reproduction condition to the processor unit 300 (step S03).

The reproduction condition specified in step S01 includes a condition necessary for generating the control filter F(x, 0, ω). Specifically, this condition includes 1) the disposing interval Δx of the speakers 501, 2) the number N of the speakers 501 in the speaker array SA, 3) the distance yref from the speaker array SA to the control line CL in the y axis direction, and 4) the width lb of the reproduction line BL. The reproduction condition specified in step S01 further includes 5) a volume of the reproduction sound on the reproduction line BL and 6) a deflection angle at which the radiating direction of the audio beam BM is deflected and the like. The reproduction condition does not have to include some of or all of the conditions 1) to 6).

In step S01, the user may specify different sound source names of a plurality of reproduction sounds using the touch panel 101 and may specify a reproduction condition for each reproduction sound. In this case, the input unit 100 transmits the plurality of specified sound source names to the data unit 200 in step S02, and transmits the specified reproduction condition for each reproduction sound to the processor unit 300 in step S03.

If receiving one or more sound source names (step S04), the data unit 200 transmits one or more sound source data 201 corresponding to the one or more sound source name to the processor unit 300 (step S05).

The processor unit 300 is assumed to receive the reproduction conditions of one or more reproduction sounds (step S06). In this case, using the reproduction condition, as a target (hereinafter, a target reproduction condition), of one reproduction sound (hereinafter, a target reproduction sound) from the received reproduction conditions of the one or more reproduction sounds, the filter generating unit 301 assigns the conditions 1) to 4) included in the target reproduction condition to the formula (7). The filter generating unit 301 thus generates the control filter F(x, 0, ω) that achieves the area reproduction under the target reproduction condition (step S07).

The target reproduction condition includes the condition 5) (the volume of the reproduction sound on the reproduction line BL). In this case, the filter generating unit 301 calculates the control filter F(x, 0, ω) using the conditions 1) to 4). The filter generating unit 301 multiplies the generated control filter F(x, 0, ω) by a ratio r (=volume/maximum volume of the target reproduction sound) of the volume of the target reproduction sound represented by the condition 5) with respect to a predetermined maximum volume. The filter generating unit 301 then generates a multiplied result r·F(x, 0, ω) as the control filter F(x, 0, ω).

On the other hand, the target reproduction condition includes not some or all of the conditions 1) to 4) in some cases as described above. When the target reproduction condition does not include the conditions 1) and 2), the filter generating unit 301 acquires the disposing interval Ax of the speakers 501 and the number N of the speakers 501 in the speaker array SA, the disposing interval Δx and the number N being stored in the ROM in advance, and sets them as the conditions 1) and 2).

When the target reproduction condition does not include the condition 3), the filter generating unit 301 acquires information about a position of a person from a predetermined sensor, not illustrated, installed in or outside the area reproduction system 1. The filter generating unit 301 then sets the condition 3) for setting the control line CL based on the acquired information about the position of the person.

Specifically, the predetermined sensor includes, for example, a camera and a sensor that acquires a thermal image and the like. The predetermined sensor may be installed in the device of the reproduction unit 500 or outside the area reproduction system 1. The predetermined sensor may transmit an output signal to the processor unit 300.

For example, a camera, not illustrated, which captures an image in the y axis direction, is disposed as the predetermined sensor on the x axis identical to the speaker array SA. in this case, the filter generating unit 301 acquires a captured image output from the camera, and recognizes whether the captured image includes a person using a publicly-known image recognizing technique and the like. When recognizing that the captured image includes a person, the filter generating unit 301 calculates a distance of the y axis direction from the x axis to the position of the person based on a ratio of a size of the recognized image indicating the person to a size of the captured image and the like.

Alternatively, a sensor (for example, a depth sensor), which can measure the distance of the y axis direction from the x axis to the position of the person and can output a signal representing the measured distance to the processor unit 300, is disposed as the predetermined sensor. In this case, the filter generating unit 301 acquires the distance of the y axis direction from the x axis to the position of the person, the distance being represented by the output signal from the sensor.

The filter generating unit 301 sets the distance of the y axis direction from the x axis to the position of the person as the condition 3) (the distance yref of the y axis direction from the speaker array SA to the control line CL).

When the target reproduction condition does not include the condition 4), the filter generating unit 301 acquires a fixed value (for example, 1 m) predetermined as a breadth of the person, for example, the fixed value being stored in the ROM or the like in advance, and sets the fixed value as the condition 4) (the width lb of the reproduction line BL).

The filter generating unit 301 can automatically set the conditions 1) to 4) based on the information about the position of the person acquired from the predetermined sensor without troubling the user to specify the conditions 1) to 4) necessary for setting the control line CL. This enables the filter generating unit 301 to automatically set the control line CL.

The processor unit 300 then receives one or more sound source data 201 corresponding to one or more sound source names specified in step S02 (step S08). in this case, the processing unit 302 executes the processing. Specifically, in the processing, the processing unit 302 convolves the reproduction sound signal corresponding to the sound source data 201 of the target reproduction sound in the one or more received sound source data 201 with the control filter F(x, 0, ω) generated in step S07 to generate the drive signal D (step S09).

More specifically, in step S09, the processing unit 302 convolves a reproduction sound signal S(2πd) corresponding to the sound source data 201 of the target reproduction sound with a control filter F(x, 0, 2πf) generated in step S07. Thus, the processing unit 302 generates a drive signal D (x, 0, 2πf) (D(x, 0, 2πf)=S(2πf)F(x, 0, 2πf)) obtained by convolving the reproduction sound signal S(2πf) with the control filter F(x, 0, 2πf).

If the target reproduction condition includes the deflection angle (YES in step S10), the directional angle control unit 303 executes the directional angle control process. Specifically, the directional angle control unit 303 adjusts a phase of the target reproduction sound to be output from each of the plurality of speakers 501 so that the radiating direction of an audio beam is deflected by the deflection angle (step S11) in the directional angle control process.

More specifically, in step S11, the directional angle control unit 303 adjusts, as described above, the phase of the drive signal D(x, 0, 2πf) generated in step S09 so as to adjust drive start timings of the speakers 501. Thus, the directional angle control unit 303 adjusts the phase of the target reproduction sound to be output from each of the plurality of speakers 501.

If the target reproduction condition does not include the deflection angle (NO in step S10) or step S11 is executed and the drive signals D corresponding to all the sound source data 201 received in step S08 is not generated (NO in step S12), the process returns to step S07. Hereinafter, the process in step S07 and thereafter steps are executed under the reproduction condition of one reproduction sound whose corresponding drive signal D is not generated in the reproduction conditions of the one or more reproduction sounds received in step S06, as the target reproduction condition of the target reproduction sound.

On the other hand, if the drive signal D corresponding to all the sound source data 201 received in step 508 is generated (YES in step S12), the synthesizing unit 304 synthesizes the drive signals D corresponding to all the sound source data 201 received in step S08, and transmits the synthesized signal to the reproduction unit 500 (step S13).

The reproduction unit 500 drives the plurality of speakers 501 in accordance with the received signals, and causes each of the plurality of speakers 501 to output a synthesized reproduction sound obtained by synthesizing the reproduction sound represented by the sound source data 201 received in step S08 (step S14).

(Specific Example)

A specific example of a result of deflecting the radiating directions of the audio beam BM representing the plurality of reproduction sounds with different frequencies in the operation illustrated in FIG. 6 will be described. In this specific example, the audio beam BM representing reproduction sounds indicated by sine wave signals with frequencies f of 500 Hz, 1000 Hz, 2000 Hz, and 5000 Hz is radiated under following identical conditions.

As illustrated in FIG. 2, the used speaker array SA is configured by disposing the 64 (N=64) speakers 501 with width of 35 mm at the disposing interval Δx of 35 mm on the x axis, and has their length L which is 2.24 m in the longitudinal direction. The y axis is a line perpendicular to a center of the x axis direction in the speaker array SA.

In step S01, the reproduction condition is set so that the distance yref between the speaker array SA and the control line CL is 2 m, the center of the reproduction line BL in the x axis direction is on the y axis (x=0), and the width lb of the reproduction line BL in the control line CL is 1 in. That is, in step S06, the processor unit 300 receives the reproduction condition in which the condition 1) (the disposing interval Δx of the speakers 501) is 35 mm and the condition 2) (the number N of the speakers S01 in the speaker array SA) is 64. In step S06, the processor unit 300 receives the reproduction condition in which the condition 3) (the distance yref from the speaker array SA to the control line CL in the y axis direction) is 2 m and the condition 4) (the width lb of the reproduction line BL in the control line CL) is 1 m.

Further, the reproduction condition representing that the deflection angle is "38° " is set in order to deflect the audio beam BM representing the reproduction sounds to the direction Da where an angle of "38° " is formed in the −x direction with respect to the y direction.

Figure 7:
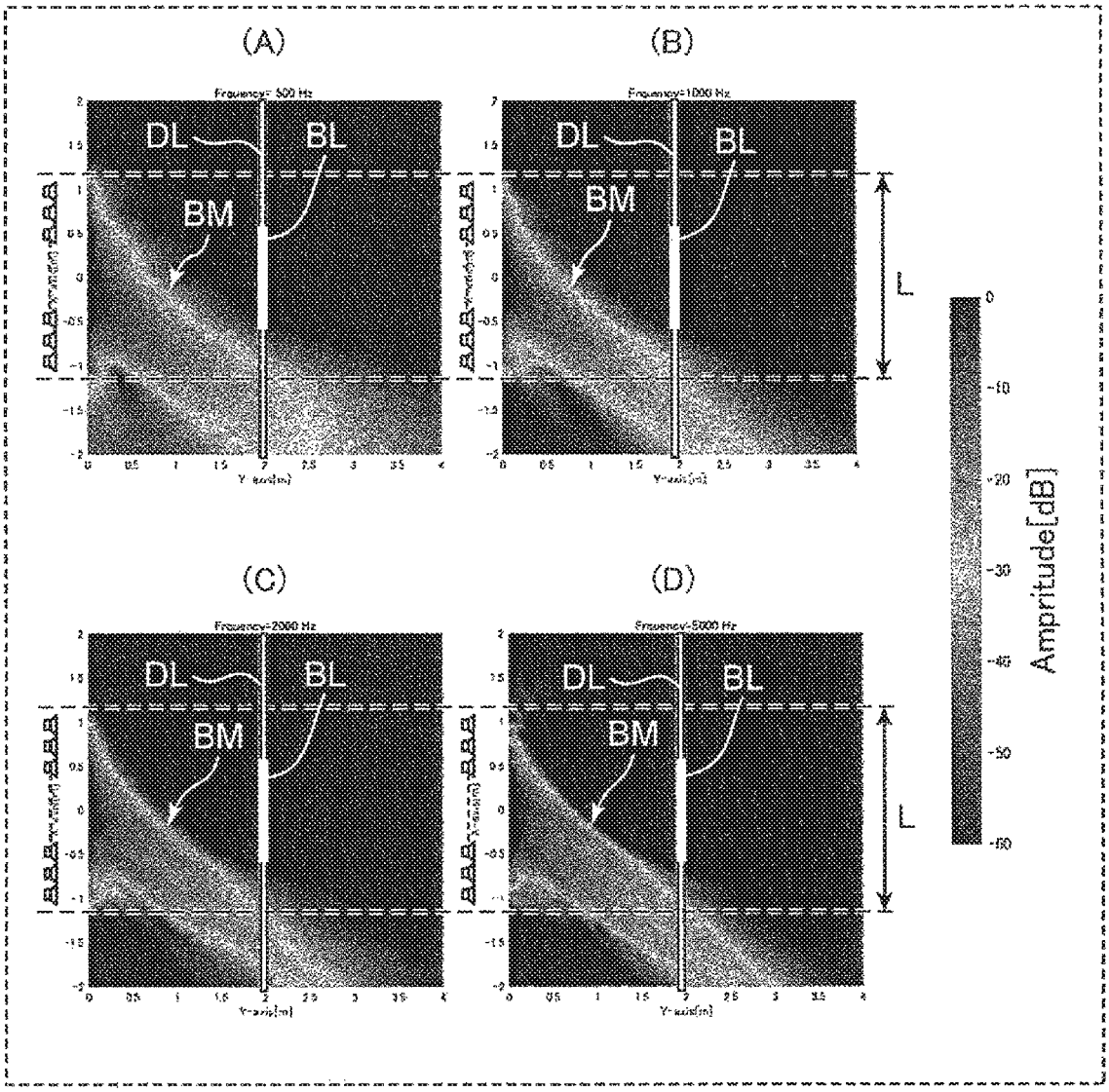
FIG. 7 is a diagram illustrating examples of results of deflecting the radiating direction of the audio beam representing a plurality of reproduction sounds of different frequencies.

FIG. 7 is a diagram illustrating examples of results of deflecting the radiating direction of the audio beam BM representing the plurality of reproduction sounds with different frequencies f. FIGS. 7(A) to (D) illustrate sound pressure distribution when the radiating direction of the audio beam BM is deflected by specifying the sound source names of reproduction sounds represented by the sine wave signals with frequencies f of 500 Hz, 1000 Hz, 2000 Hz, and 5000 Hz and the reproduction conditions and performing the operation illustrated in FIG. 6.

As illustrated in FIGS. 7(A) to (D), the audio beam BM can be radiated to a direction deflected to the −x direction with respect to the y direction which is the front direction of the speaker array SA by the deflection angle "38° " in accordance with the operation illustrated in FIG. 6. Thus, even if the reproduction line BL is set in the position opposed to the end of the speaker array SA in the longitudinal direction, the audio beam BM can be radiated to an area which is not opposed to the speaker array SA. This can prevent the radiable range of the audio beam BM from being limited by the length L of the speaker array SA in the longitudinal direction.

In step S09, the drive signal D(x, 0, πf) for causing the plurality of speakers 501 to output the reproduction sound is generated so that the audio beam BM is radiated to the reproduction line BL. Thereafter, in step S11, the phase of the drive signal D of the speakers 501 is adjusted so that the radiating direction of the audio beam BM is deflected by the deflection angle.

Thus, for example, after end of the operation illustrated in FIG. 6, the user may specify only a deflection angle different from previous one using the input unit 100 in step S01. Steps S02, S04, S05, and S07 to S09 are omitted, and the process after step S11 (the directional angle control process) may be executed by using the specified deflection angle and the drive signal D generated in step S09 (the processing).

In this case, steps S02, S04, S05, and S07 to S09 are omitted. Thus, as illustrated in FIG. 6, in step 501, the control line CL and the deflection angle different from previous ones are again set, and thus using the control line CL and the deflection angle again set, the radiating direction of the audio beam BM can be adjusted more quickly than in a case where steps S07 to S11 are executed.

Modifications

The embodiment of the present disclosure has been described above, but an entity and the device that are subject to the processes are not limited to those described in the above-described embodiment. The embodiment of the present disclosure may be, for example, following modifications.

Figure 8:
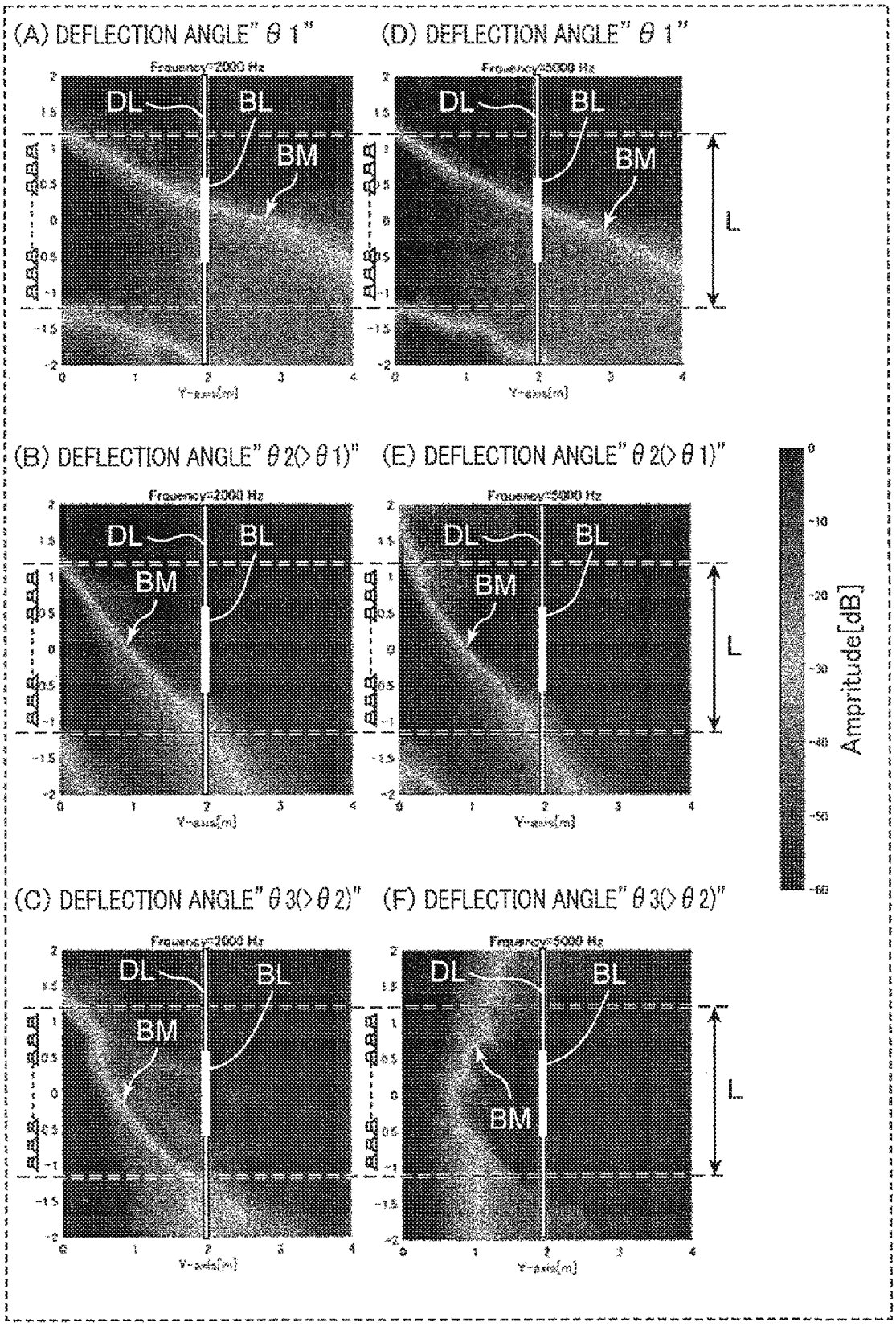
FIG. 8 is a diagram illustrating examples of results of deflecting the radiating direction of the audio beam representing a plurality of reproduction sounds of different frequencies with deflection angles being varied.

(1) FIG. 8 is a diagram illustrating examples of results of deflecting the radiating direction of the audio beam BM representing a plurality of reproduction sounds of different frequencies with deflection angles being varied. FIG. 8(A) illustrates the sound pressure distribution when a sound source name of a reproduction sound represented by a sine wave signal with frequency f of 2000 Hz and the conditions 1) to 4) similar to the specific example described with reference to FIG. 7 are set as the reproduction condition, the deflection angle included in the reproduction condition is set to "θ1", and the operation illustrated in FIG. 6 is performed. FIG. 8(B) illustrates the sound pressure distribution similar to FIG. 8(A) when the deflection angle included in the reproduction condition is set to "θ2 (>θ1)" which is larger than "θ1". FIG. 8(C) illustrates the sound pressure distribution similar to FIG. 8(A) when the deflection angle included in the reproduction condition is set to "θ3 (>θ2)" which is larger than "θ2". FIGS. 8(D) to (F) illustrate the sound pressure distributions similar to FIGS. 8(A) to (C) when a sound source name of a reproduction sound represented by a sine wave signal with frequency f of 5000 Hz is specified.

As illustrated in FIGS. 8(A) to (C), in accordance with the operation illustrated in FIG. 6, the radiating direction of the audio beam BM representing the reproduction sound with frequency f of 2000 Hz can be deflected by the deflection angles "θ1" to "θ3". As illustrated in FIGS. 8(D) and (E), in accordance with the operation illustrated in FIG. 6, the radiating direction of the audio beam BM representing the reproduction sound with frequency f of 5000 Hz can be deflected by the deflection angles "θ1" and "θ2" similarly to FIGS. 8(A) and (B).

As illustrated in FIG. 8(F), however, in accordance with the operation illustrated in FIG. 6, when the radiating direction of the audio beam BM representing the reproduction sound with frequency f of 5000 Hz is tried to be deflected by the deflection angle "θ3", the radiating direction of the audio beam BM cannot be deflected similarly to FIG. 8(C). In this case, a so-called grating lobe which strengthens sound waves around the speaker array SA is generated. Thus, as described below, the user may limit the frequency f of the reproduction sound so that the grating lobe is not generated, the frequency f being capable of being specified by the user.

Figure 9:
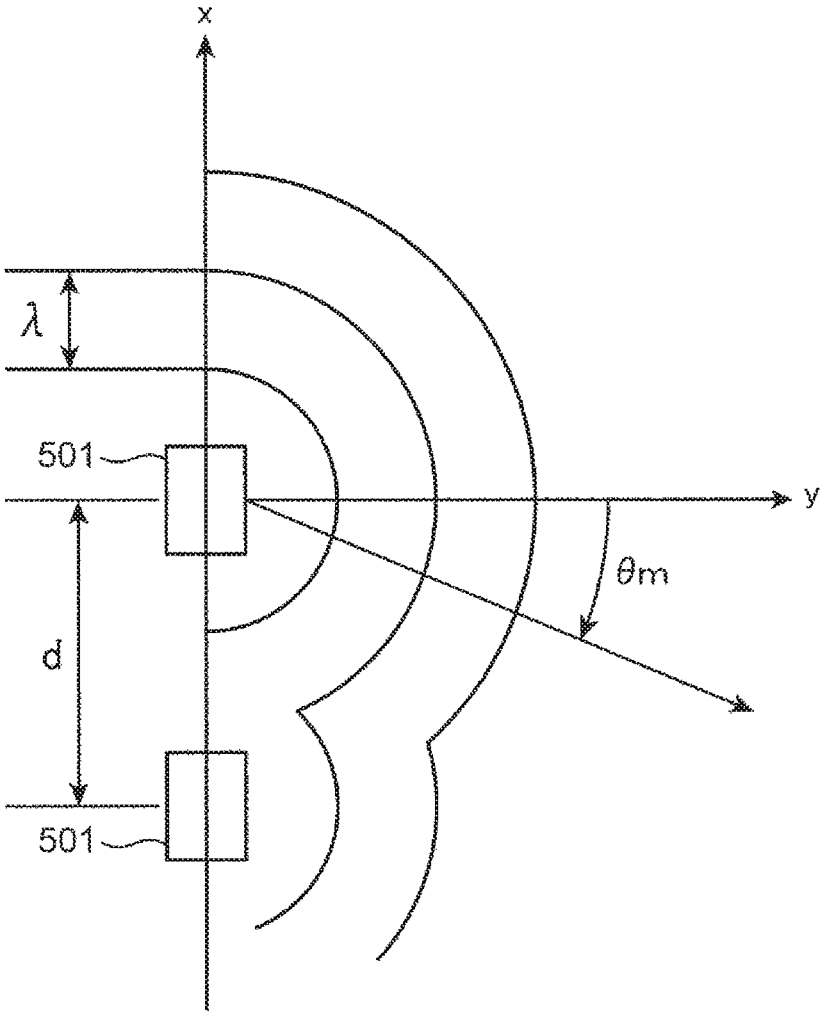
FIG. 9 is a diagram illustrating a condition under which generation of a grating lobe is suppressed.

FIG. 9 is a diagram illustrating a condition under which generation of a grating lobe is suppressed. As illustrated in FIG. 9, each of the plurality of speakers 501 disposed linearly along the x direction at the disposing interval d outputs reproduction sound with wavelength λ. In this case, it has been known that a following formula (10) has to be satisfied in order to prevent the generation of the grating lobe within an area where an angle "$\theta_m$" is formed in the −x direction with respect to the y direction from the speakers 501.

[Expression 11]

$$d < \frac{\lambda}{1 + \sin\theta_m} \tag{10}$$

The formula (10) can be deformed into a following formula (11) by using the disposing interval Δx of the plurality of speakers 501, the sound speed c, and the deflection angle θ.

[Expression 12]

$$f < \frac{c}{\Delta x(1 + \sin\theta)} \tag{11}$$

Therefore, in accordance with the operation illustrated in FIG. 6, the frequency f of the reproduction sound, the frequency f being capable of being specified in step S01, may be limited to the frequency f that satisfies the formula (11) so that the generation of the grating lobe is prevented.

Specifically, in step S08, the processor unit 300 may determine whether the one or more sound source data 201 received from the data unit 200 includes the sound source data 201 of the reproduction sound with frequency f which does not satisfy the formula (11). The processor unit 300 is assumed to determine that the sound source data 201 includes the sound source data 201 of the reproduction sound with frequency f which does not satisfy the formula (11). In this case, the processor unit 300 may transmit, to the input unit 100, a warning signal representing that the sound source name representing the reproduction sound with frequency f generating the grating lobe is specified, and may end the operation illustrated in FIG. 6.

Accordingly, when the input unit 100 receives the warning signal, for example, the input unit 100 may display, on the touch panel 101, a message which indicates that the sound source name representing the reproduction sound with frequency f generating the grating lobe is specified. In such a manner, when receiving the warning signal, the input unit 100 may inform the user of the specified sound source name representing the reproduction sound with frequency f generating the grating lobe.

According to the present modification, the reproduction sound with frequency f satisfying the formula (11) is output from the plurality of speakers 501, and thus the generation of the grating lobe can be avoided.

(2) The input unit 100 may be configured so that in step S01 the user can specify a plurality of reproduction conditions including different deflection angles as the reproduction conditions for the area reproduction of a plurality of identical reproduction sounds.

Figure 10:
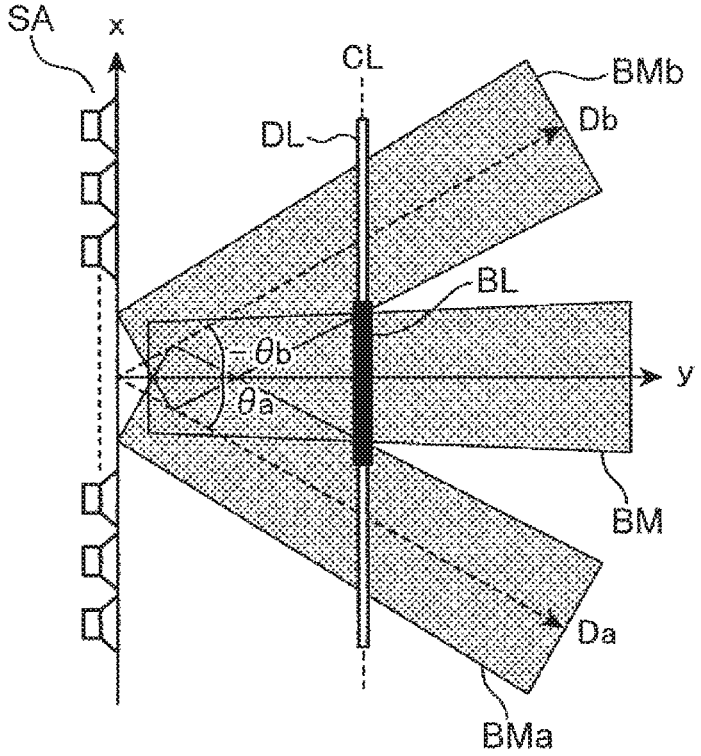
FIG. 10 is a diagram illustrating an example of an operation for radiating a plurality of audio beams.

FIG. 10 is a diagram illustrating an example of the operation for radiating the plurality of audio beams BM, BMa, and BMb. For example, the input unit 100 may be configured so that in step S01 the user specifies a sound source name of a reproduction sound and, as illustrated in FIG. 10, specifies a first reproduction condition for radiating the audio beam BM without a deflection angle to the y direction which is the front direction of the speaker array SA. Furthermore, the input unit 100 may be configured so that in step S01 the user can specify following second and third reproduction conditions as well as the first reproduction condition.

The second reproduction condition is, as illustrated in FIG. 10, for deflecting the radiating direction of the audio beam BMa to the direction Da in which an angle "θa" is formed in the −x direction with respect to the y direction, and further includes a deflection angle "θa" in addition to the first reproduction condition. The third reproduction condition is, as illustrated in FIG. 10, for deflecting the radiating direction of the audio beam BMa to the direction Db in which an angle "−θb" (an angle "θb" in the x direction) is formed in the −x direction with respect to the y direction, and further includes a deflection angle "−θb" in addition to the first reproduction condition.

In step S01, the input unit 100 may be configured to automatically set setting values of the reproduction line BL and the non-reproduction line DL, the setting values being included in the first reproduction condition, as setting values of the reproduction line BL and the non-reproduction line DL, the setting values being included in the second and third reproduction conditions.

In the configuration according to the present modification, the plurality of reproduction conditions is received in step S06, and only the one sound source data 201 is received in step S08. Thus, the determination may be made in step S12 whether the control filter (hereinafter, the control filter corresponding to all the reproduction conditions) for achieving the area reproduction under all the reproduction conditions received in step S06 is generated.

If the determination is made that the control filter corresponding to all the reproduction conditions received in step S06 is not generated, the target reproduction sound is not changed, and step S07 and thereafter steps may be executed under a reproduction condition in which a corresponding control filter is not generated, as the target reproduction condition. If the determination is made that the control filter corresponding to all the reproduction conditions received in step S06 is generated, the process may proceed to step S13.

That is, in the configuration according to the present modification, in step S09, the processing unit 302 generates the drive signal D (hereinafter, a first drive signal D1) for the area reproduction of a reproduction sound under the first reproduction condition. In next step S09, the processing unit 302 generates the drive signal D (hereinafter, a second drive signal D2) for area reproduction of the reproduction sound identical to the one reproduction sound under the reproduction condition identical to the first reproduction condition included in the second reproduction condition. In this case, in step S11, the directional angle control unit 303 adjusts a phase of the second drive signal D2 in accordance with the deflection angle "θa" included in the second reproduction condition.

In next step S09, the processing unit 302 generates the drive signal D (hereinafter, a third drive signal D3) for area reproduction of the reproduction sound identical to the one reproduction sound under the reproduction condition which is identical to the first reproduction condition and is included in the third reproduction condition. In this case, in step S11, the directional angle control unit 303 adjusts a phase of the third drive signal D3 in accordance with the deflection angle "−θb" included in the third reproduction condition.

In step S13, the synthesizing unit 304 synthesizes the first the drive signal D1 (an example of a reproduction sound which has been subject to the processing) with the second the drive signal D2 and the third the drive signal D3 (examples of the reproduction sound which has been subject to the processing and the directional angle control process). In step S14, the signal synthesized in step S13 (an example of the first synthesized reproduction sound) drives the plurality of speakers 501.

Thus, as illustrated in FIG. 10, the audio beam BM is radiated to the y direction and to the reproduction line BL. The audio beam BMa is radiated to the direction Da and also to a position closer to the −x direction with respect to the reproduction line BL. The audio beam BMb is radiated to the direction Db and also to a position closer to the x direction with respect to the reproduction line BL. A radiating range of the audio beam BM can be, thus, made to be wider than the reproduction line BL without changing the setting of the reproduction line BL.

Figure 11:
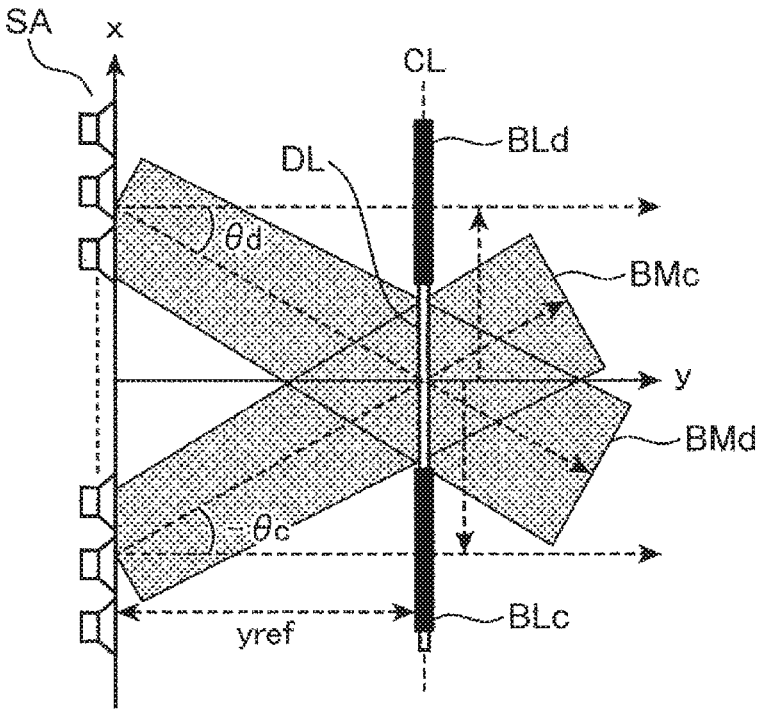
FIG. 11 is a diagram illustrating an example of an operation for radiating the plurality of audio beams in an intersecting manner.

(3) The input unit 100 may be configured so that in step S01 the user can specify a sound source name of a reproduction sound and can specify following fourth and fifth reproduction conditions in which settings of the reproduction line BL and the deflection angle are different each other. FIG. 11 is a diagram illustrating an example of an operation for radiating a plurality of audio beams BMc, BMd in an intersecting manner.

The fourth reproduction condition is, as illustrated in FIG. 11, for setting the control line CL in a position separated from the speaker array SA by the distance yref. The fourth reproduction condition is for setting the reproduction line BLc so that a position separated to the −x direction from an intersection point between the control line CL and the y axis is a center position. The fourth reproduction condition is for setting, as the non-reproduction line DL, an area on the control line CL, the area being different from the reproduction line BLc. Further, the fourth reproduction condition is for setting a deflection angle "−θc" so that the radiating direction of the audio beam BMc is deflected to the −x direction by an angle "−θc" (an angle "θc" in the x direction).

On the other hand, the fifth reproduction condition is, as illustrated in FIG. 11, for setting the control line CL identical to the control line CL included in the fourth reproduction condition. That is, the fifth reproduction condition is for setting the control line CL (an example of an additional control line) in a position separated from the speaker array SA by the distance yref The fifth reproduction condition is for setting the reproduction line BLd (an example of an additional reproduction line) so that a position separated to the x direction from the intersection point between the control line CL and the y axis is the center position. The fifth reproduction condition is for setting, as the non-reproduction line DL (an example of an additional non-reproduction line), an area on the control line CL, the area being different from the reproduction line BLd. Further, the fifth reproduction condition is for setting a deflection angle "θd" so that a radiating direction of the audio beam BMd (an example of an additional audio beam) is deflected to the −x direction by the angle The deflection angle which can be set as the fifth reproduction condition is, as illustrated in FIG. 11 limited to an angle at which a part of the audio beam BMc radiated under the fourth reproduction condition intersects a part of the audio beam BMd radiated under the fifth reproduction condition on the control line CL set in the position separated from the speaker array SA by distance yref.

Specifically, the user is set the deflection angle different from the limited angle as the fifth reproduction condition. In this case, the directional angle control unit 303 executes a process (a part of the intersection adjusting process) for generating, for example, a message indicating that an improper deflection angle is input or a message indicating guidance for setting a proper deflection angle as well as angle candidates which can be set as the deflection angle. The directional angle control unit 303 executes a process (a part of the intersection adjusting process) for transmitting an instruction signal for displaying the generated messages on the touch panel 101 to the input unit 100. When receiving the instruction signal, the input unit 100 causes the messages to be displayed on the touch panel 101 in accordance with the above instruction signal.

Alternatively, the input unit 100 may be configured so that the user cannot set the deflection angle of the fifth reproduction condition. The directional angle control unit 303 may execute a process (an example of the intersection adjusting process) for calculating an angle which can be set as the deflection angle of the fifth reproduction condition with reference to the fourth and fifth reproduction conditions received in step S06 and automatically setting the calculated angle as the deflection angle of the fifth reproduction condition.

In this case, similarly to the modification (2), the fourth and fifth reproduction conditions are received in step S06, and only the sound source data 201 is received in step S08. Thus, in step S12, similarly to the modification (2), a determination may be made whether a control filter corresponding to the fourth and fifth reproduction conditions received in step S06 is generated.

If the control filter corresponding to the fourth and fifth reproduction conditions received in step S06 is not generated, no target reproduction sound is changed, and the process in step S07 and thereafter steps may be executed under the reproduction condition, in which no corresponding control filter is generated, as the target reproduction condition. If the determination is made that the control filter corresponding to the fourth and fifth reproduction conditions received in step S06 is generated, the process may proceed to step S13.

That is, in the configuration according to the present modification, in step S09, the processing unit 302 generates the drive signal D (hereinafter, a fourth drive signal D4) for radiating the audio beam BMc representing one reproduction sound to the reproduction line BLc under the fourth reproduction condition. In step S11, the directional angle control unit 303 adjusts a phase of the fourth drive signal D4 in accordance with the deflection angle "−θc" included in the fourth reproduction condition.

In next step S09 (an example of the additional processing), the processing unit 302 generates the drive signal D (hereinafter, a fifth drive signal D5) for radiating the audio beam BMd representing a reproduction sound identical to the one reproduction sound to the reproduction line BLd under the fifth reproduction condition. In step S11 (a part of the intersection adjusting process), the directional angle control unit 303 adjusts a phase of the fifth drive signal D5 in accordance with the deflection angle "θd" included in the fifth reproduction condition. Thus, the directional angle control unit 303 adjusts the phase of the fifth drive signal D5 so that a part of the audio beam BMc intersects a part of the audio beam BMd on the control line CL.

In step S13, the synthesizing unit 304 (an example of the second synthesizing unit) synthesizes the fourth drive signal D4 (an example of the reproduction sound which has been subject to the processing and the directional angle control process) with the fifth drive signal D5 (an example of the additional reproduction sound which has been subject to the additional processing and the intersection adjusting process). In step S14, the signal synthesized in step S13 (an example of the second synthesized reproduction sound) drives the plurality of speakers 501.

In the configuration according to the present modification, as illustrated in FIG. 11, the radiating direction of the audio beam BMc is deflected from the y direction directing the reproduction line BLc to the −x direction by the deflection angle "−θc" (in the x direction at the angle "θc"), and the audio beam BMc is radiated to a position closer to the x direction with respect to the reproduction line BLc. Further, the deflection angle "θd" included in the fifth reproduction condition is set so that a part of the audio beam BMc intersects a part of the audio beam BMd on the control line CL set in the position separated from the speaker array SA by the distance yref.

Thus, the radiating direction of the audio beam BMd is deflected from the y direction directing the reproduction line BLd to the −x direction by the deflection angle "θd", and the audio beam BMd is radiated to a position closer to the −x direction with respect to the reproduction line BLd. A part of the audio beam BMc intersects a part of the audio beam BMd on the control line CL. Therefore, in an area where a part of the audio beam BMc intersects a part of the audio beam BMd on the control line CL, a sound pressure of a reproduction sound can be increased.

(4) The input unit 100 may be configured so that in step S01 the user can specify only a sound source name of one reproduction sound using the touch panel 101 so as to be capable of specifying only one reproduction condition corresponding to the reproduction sound. Accordingly, the synthesizing unit 304, step S12, and step S13 are omitted, and the directional angle control unit 303 may transmit the drive signal D generated in step S09 or the drive signal D whose phase is adjusted in step S11 to the reproduction unit 500.

The respective processes in the embodiment and the modifications may be executed by a processor installed in a specific device (hereinafter, a local device) of the area reproduction system 1. The respective processes may be executed by a cloud server installed in a place different from a place of the local device. The respective processes may be executed by the local device and the cloud server in a shared manner such that information is shared between the local device and the cloud server.

The present disclosure can be used for controlling a sound wave to be reproduced from a speaker array. A speaker array system to which the present disclosure is applied has industrial applicability in a field of an audio announcement system, a remote conference system, an AV system. and the like.

This application is based on Japanese Patent application No. 2018-127278 filed in Japan Patent Office on Jul. 4, 2018, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. An area reproduction system comprising:

a reproduction unit including a speaker array configured by disposing a plurality of speakers linearly;

a processing unit that executes processing for processing a reproduction sound to be output from each of the plurality of speakers, based on a control line including a reproduction line that strengthens a sound wave radiated from the speaker array and a non-reproduction line that weakens the sound wave, so that an audio beam of a predetermined sound pressure or more is radiated only to the reproduction line, the control line being substantially parallel with the speaker array and being set in a position separated from the speaker array by a predetermined distance; and a directional angle control unit that executes a directional angle control process for adjusting a phase of the reproduction sound so that a radiating direction of the audio beam is deflected by a specified angle, wherein the reproduction unit causes each of the plurality of speakers to output the reproduction sound which has been subject to the processing and the directional angle control process, and a frequency of the reproduction sound satisfies a following formula using a disposing interval of the plurality of speakers, a sound speed, and the specified angle:

$$f < \frac{c}{\Delta x(1 + \sin\theta)}$$

where, f represents the frequency of the reproduction sound, Δx represents the disposing interval of the plurality of speakers, c represents the sound speed and θ represents the specified angle.

2. The area reproduction system according to claim 1, wherein the processing unit convolves a reproduction sound signal representing the reproduction sound with a control filter which achieves the control line and generates a convolved signal as a drive signal for causing each of the plurality of speakers to output the reproduction sound in the processing, and the directional angle control unit, in the directional angle control process, adjusts a phase of the drive signal generated in the processing.

3. The area reproduction system according to claim 1, further comprising a first synthesizing unit that synthesizes the reproduction sound that has been subject to the processing and the directional angle control process with the reproduction sound that has been subject to the processing, wherein the reproduction unit causes the plurality of speakers to output a first synthesized reproduction sound synthesized by the first synthesizing unit.

4. The area reproduction system according to claim 1, wherein the processing unit further executes additional processing for processing an additional reproduction sound identical to the reproduction sound, based on an additional control line including an additional reproduction line that strengthens a sound wave radiated from the speaker array and an additional non-reproduction line that weakens the sound wave, so that an additional audio beam of the predetermined sound pressure or more is radiated only to the additional reproduction line, the additional control line being substantially parallel with the speaker array and being set in a position separated from the speaker array by the predetermined distance, the directional angle control unit further executes an intersection adjusting process for adjusting a phase of the additional reproduction sound so that a part of the audio beam intersects a part of the additional audio beam in a position separated from the speaker array by the predetermined distance, the area reproduction system further comprises a second synthesizing unit that synthesizes the reproduction sound which has been subject to the processing and the directional angle control process with the additional reproduction sound which has been subject to the additional processing and the intersection adjusting process, and the reproduction unit causes the plurality of speakers to output a second synthesized reproduction sound synthesized by the second synthesizing unit.

5. An area reproduction method being performed by a computer of an area reproduction system including a speaker array configured by disposing a plurality of speakers linearly, the method comprising:

causing the computer to execute processing for processing a reproduction sound to be output from each of the plurality of speakers, based on a control line including a reproduction line that strengthens a sound wave radiated from the speaker array and a non-reproduction line that weakens the sound wave, so that an audio beam of a predetermined sound pressure or more is radiated only to the reproduction line, the control line being substantially parallel with the speaker array and being set in a position separated from the speaker array by a predetermined distance, and a directional angle control process for adjusting a phase of the reproduction sound so that a radiating direction of the audio beam is deflected by a specified angle; and causing each of the plurality of speakers to output the reproduction sound which has been subject to the processing and the directional angle control process, wherein a frequency of the reproduction sound satisfies a following formula using a disposing interval of the plurality of speakers, a sound speed, and the specified angle:

$$f < \frac{c}{\Delta x(1 + \sin\theta)}$$

where, f represents the frequency of the reproduction sound, Δx represents the disposing interval of the plurality of speakers, c represents the sound speed and θ represents the specified angle.

* * * * *